United States Patent [19]

Burton, Jr.

[11] Patent Number: 4,600,056

[45] Date of Patent: Jul. 15, 1986

[54] METHOD AND APPARATUS FOR COMPLETING WELL

[75] Inventor: Guy C. Burton, Jr., Casper, Wyo.

[73] Assignee: Rejane M. Burton, Casper, Wyo. ; a part interest

[21] Appl. No.: 698,130

[22] Filed: Feb. 4, 1985

Related U.S. Application Data

[63] Continuation-in-part of Ser. No. 593,394, Mar. 26, 1984.

[51] Int. Cl.[4] ..... E21B 33/16; E21B 33/122

[52] U.S. Cl. ..... 166/291; 166/191; 166/285; 166/387

[58] Field of Search ..... 166/180, 187, 191, 285, 166/291, 386, 387

[56] References Cited

U.S. PATENT DOCUMENTS

| | | | |
|---|---|---|---|
| 1,000,583 | 8/1911 | Cooper | 166/187 X |
| 2,174,795 | 10/1939 | Layne | 166/187 X |
| 3,437,142 | 4/1969 | Conover | 166/187 X |
| 3,493,052 | 2/1970 | Evans et al. | 166/387 X |
| 3,653,441 | 4/1972 | Tuttle | 166/291 |
| 3,865,188 | 2/1975 | Doggett et al. | 166/187 X |
| 3,945,436 | 3/1976 | Nebolsine | 166/187 X |
| 4,312,405 | 1/1982 | Wilder | 166/291 X |
| 4,440,226 | 4/1984 | Suman, Jr. | 166/187 X |
| 4,530,402 | 7/1985 | Smith et al. | 166/285 X |

*Primary Examiner*—George A. Suchfield

*Attorney, Agent, or Firm*—Sheridan, Ross & McIntosh

[57] ABSTRACT

A method for the cementing in of a well so that the cement is not contacted by deleterious materials, such as gas, is disclosed.

11 Claims, 7 Drawing Figures

48
50
44
46
56
66
42
40
18
38
58
54
60
56
PAY
ZONE
38a 18
12
54
38

72
18
70
68
54

62
62
52
64
20
10

METHOD AND APPARATUS FOR COMPLETING WELL

FIELD OF THE INVENTION

This application is a continuation-in-part of U.S. patent application Ser. No. 593,394 filed Mar. 26, 1984.

This invention relates generally to the drilling and completion of oil and gas (more particularly gas) wells with greater than normal pressures preventing conventional "open hole" completions—or for completion of air or gas drilled wells where damage to the producing formation may occur by using various fluids or cement to kill the flow of hydrocarbons.

BACKGROUND OF THE INVENTION

The more recent oil and gas explorations have resulted in finding of such formations at depths and pressures that are substantially greater than those encountered in previous years. The conventional techniques for drilling and completing a well, such as a gas well, at depths where pressures are greater than the hydrostatic pressure of normally weighted drilling fluids are not suitable. At these depths the pressures of the gas are such that the gas permeates the cement during completion of the well deactivating its setting chemistry. Various attempts at completing wells, such as gas wells, at these depths and pressures have been prohibitively expensive and sometimes have resulted in failure. When the hydrostatic pressure of the drilling fluid is raised to the point where it does not allow the entry of hydrocarbons, the fluid is generally forced into the porosity of the pay zones sometimes destroying their ability to produce.

BRIEF DESCRIPTION OF THE INVENTION

The invention relates to method and apparatus particularly suited for completing wells, such as gas wells, at depths such that the pressure exceeds the burst strength of conventional external casing packers. During the completing procedures, gas is allowed to flow from the well at all times until it is desired to shut the well in.

In a preferred embodiment of the invention, a well is conventionally drilled to a depth of about 11,500 feet and 9 $\frac{5}{8}$ inch casing is placed. The well is drilled with an 8 $\frac{1}{2}$ inch bit using air as a circulating medium until commercial quantities of gas are encountered. During the drilling, gas will be flowing out of the well through the 9 $\frac{5}{8}$ inch casing, being diverted through a conventional blooie line and being burned as it exits at distances of 200 feet or greater from the drilling operations. 5 $\frac{1}{2}$ inch casing is run in the hole with the bottom portion sealed, such as the first two joints being filled with cement. the 5 $\frac{1}{2}$ inch casing is provided with external casing packers and is positioned so that when the end of the 5 $\frac{1}{2}$ inch casing is below the pay zone, the external packers will be in a desired position above the pay zone. The 5 $\frac{1}{2}$ inch casing is provided with cementing ports located above the external packers. The slips for the 5 $\frac{1}{2}$ inch casing are seated in the 13 $\frac{5}{8}$ inch casinghead to ensure that the gas is passing through two 4 inch outlets in the casinghead below the slips. A 2 $\frac{7}{8}$ inch tubing string is then run down the 5 $\frac{1}{2}$ inch casing with a Vannysystem perforating gun at its lower end. A tubing packer is located on the tubing string at a location below the external packers of the 5 $\frac{1}{2}$ inch casing.

In operation, the main rig is moved away after the 5 $\frac{1}{2}$ inch casing has been run and a completion rig is moved into position (or the drilling rig is used for completion). The 2 $\frac{7}{8}$ inch tubing string is run in the 5 $\frac{1}{2}$ inch casing to a desired location and then the tubing packer is activated to provide a seal between the external surface of the 2 $\frac{7}{8}$ inch tubing and the internal surface of the 5 $\frac{1}{2}$ inch casing. A christmas tree is installed and the perforating gun is fired to perforate the 5 $\frac{1}{2}$ inch casing below both external casing packers so that gas will flow through the perforated 5 $\frac{1}{2}$ inch pipe and then, because of the seal between the 2 $\frac{7}{8}$ inch tubing and the 5 $\frac{1}{2}$ inch casing, the gas flows out of the well through the 2 $\frac{7}{8}$ inch tubing and the annulus between the 9 $\frac{5}{8}$ inch–5 $\frac{1}{2}$ inch casings. Hydrostatic pressure is then established in the annular space between the 2 $\frac{7}{8}$ inch tubing and the 5 $\frac{1}{2}$ inch casing to expand the external casing packers to provide a seal between the upper and lower formations penetrated by the 8 $\frac{1}{2}$ inch drill hole. The hydrostatic pressure is increased to open the cementing ports above the external casing packers. Water is pumped down the 9 $\frac{5}{8}$ inch–5 $\frac{1}{2}$ inch annulus, through the cementing ports and up the 5 $\frac{1}{2}$ inch–2 $\frac{7}{8}$ inch tubing annulus until the water column is balanced at the surface. The water is followed by a predetermined amount of cement until the bottom of the cement is about 100 feet above the ports. In a preferred embodiment, the 2 $\frac{7}{8}$ inch tubing has a smooth external surface even at the joints so that a cementing sealing plug may be positioned between the water and the cement. Gas continues to flow through the 2 $\frac{7}{8}$ inch tubing until the cement hardens, at which time the well is shut in.

It is an object of this invention to provide method and apparatus for the completion of wells at depths such that the bottom hole pressures exceed the burst strength of existing external casing packers.

It is another object of this invention to provide method and apparatus for the cementing of a well having high pressures so that the gas will not permeate the cement.

It is a further object of this invention to provide method and apparatus for the completion of such a well by providing for the controlled flow of gas out of the well at all times until it is desired to shut in the well.

Other features and advantages of the invention will be apparent from the following more particular description of preferred embodiments as illustrated in the accompanying drawings in which like reference characters refer to the same parts through the various views. The drawings are approximately to scale, illustrating principles of the invention.

DETAILED DESCRIPTION OF THE INVENTION

Figure 1:
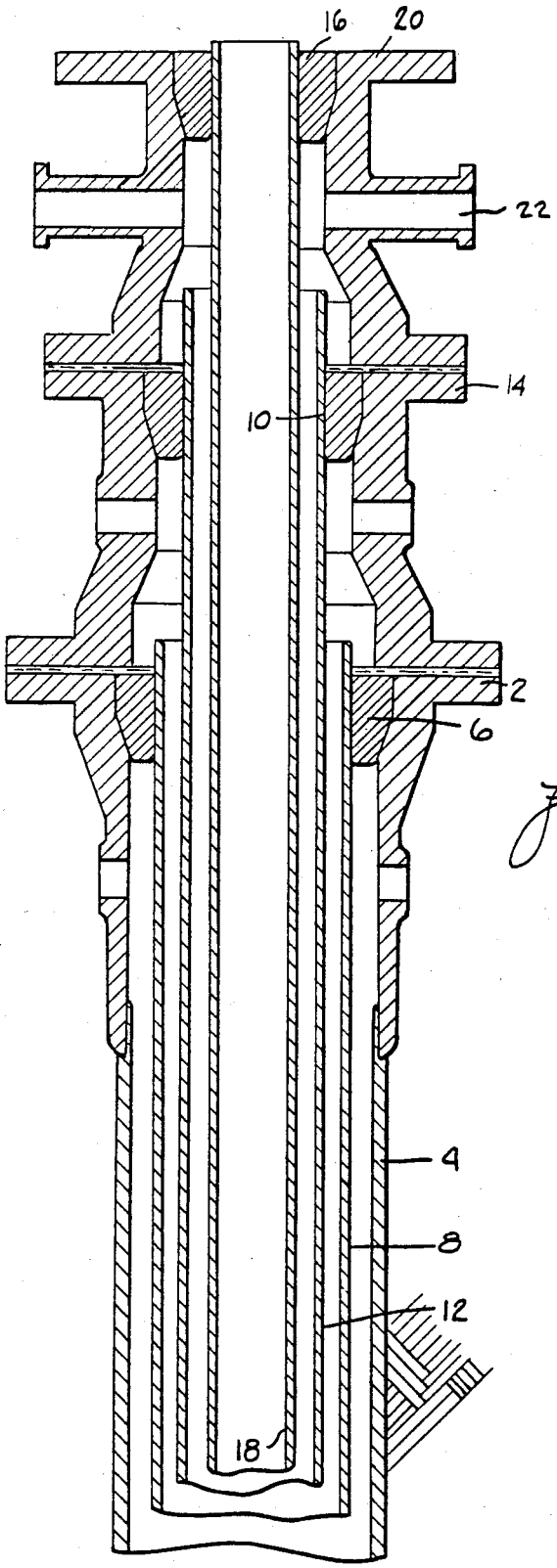
FIG. 1 is a view partially in section of some of the components in the upper portion of a conventional well.

Some of the components in the upper portion of a well are illustrated in FIG. 1. The casing head 2 of the 20 inch casing 4 is fixed in position such as being cemented in a 24 inch hole. The slips 6 for the 13 $\frac{3}{8}$ inch casing 8 are set in the casing head 2; the slips 10 for the 9 $\frac{5}{8}$ inch casing 12 are set in the casing head 14 of the casing 12; and the slips 16 of the 5 $\frac{1}{2}$ inch casing 18 are set in the casing head 20 of the casing 12. Bleed lines 22 divert gas from the 9 $\frac{5}{8}$ inch casing 12 to a blooie line. The blooie line is connected to a pit located about 200 feet or more from the rig and the gas is burned as it exits into the pit (not shown). In the preferred embodiment of the invention to be described below, the 9 $\frac{5}{8}$ inch casing 12 has been installed to a depth of about 11,500 feet and the 5 $\frac{1}{2}$ inch casing has not been installed.

Figure 2:
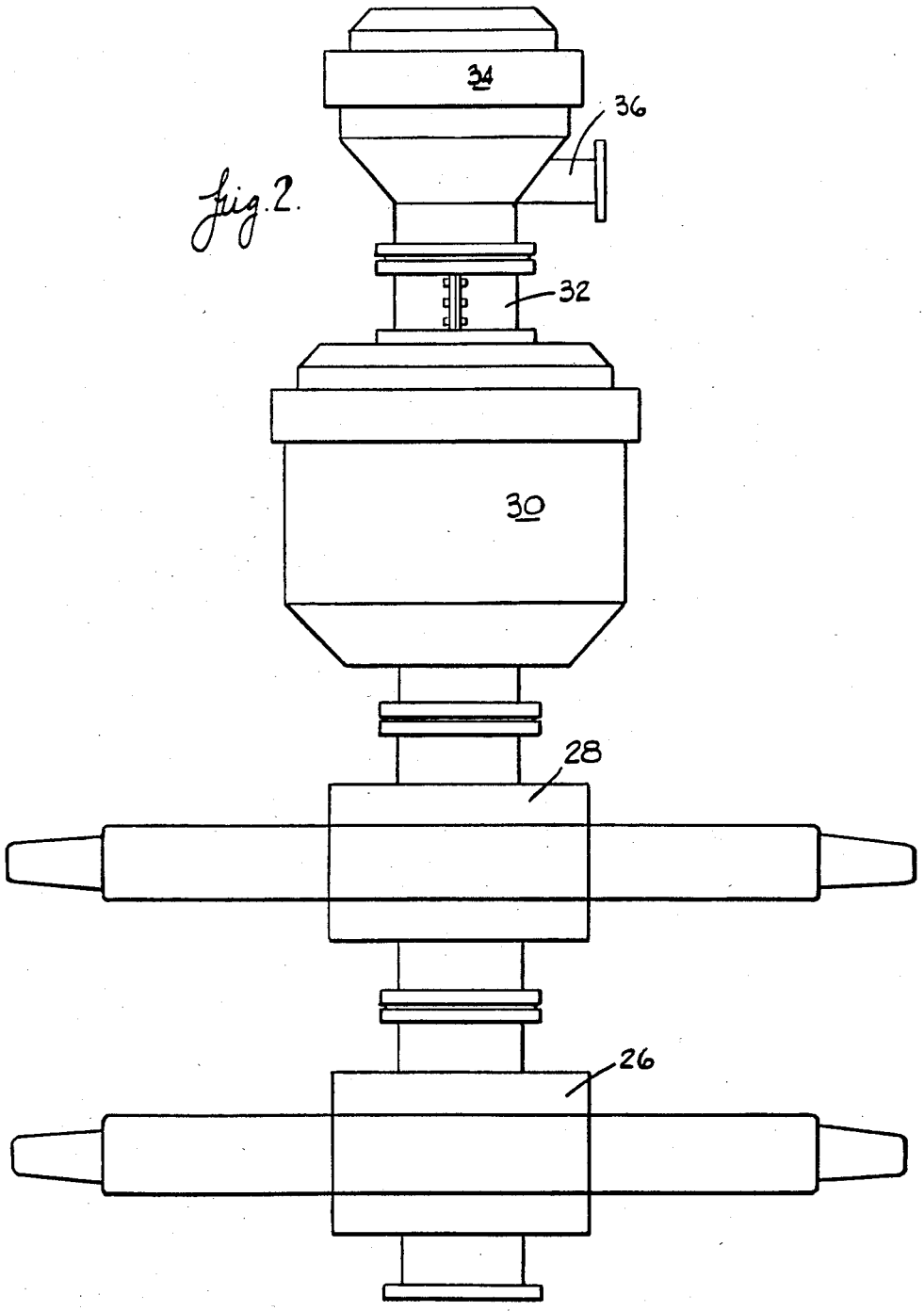
FIG. 2 is a view partially in section illustrating components located above those in FIG. 1.

As illustrated in FIG. 2, on top of the casing head 20, there are two ram type blow out preventers 26 and 28 and above them an annular type blow out preventer 30. Above the preventer 30, there is located the slip insertion spool 32, for a purpose to be described below. The rotating head 34 is above the insertion spool 32 and an exit 36 connected to a blooie line.

Suitable apparatus (not shown) is moved through and out of the 9 $\frac{5}{8}$ casing 12 and an 8 $\frac{1}{2}$ inch hole 38 is drilled below the 9 $\frac{5}{8}$ inch casing 12. The drilling of the hole is continued until the pay zone is reached and the desired commercial flow of gas is coming up between the drill bit and the 9 $\frac{5}{8}$ inch casing 12, such as a flow rate of 20 MMCFGD. At this time, the drilling is stopped and the drilling apparatus withdrawn from the well.

Figures 3, 4, 6:
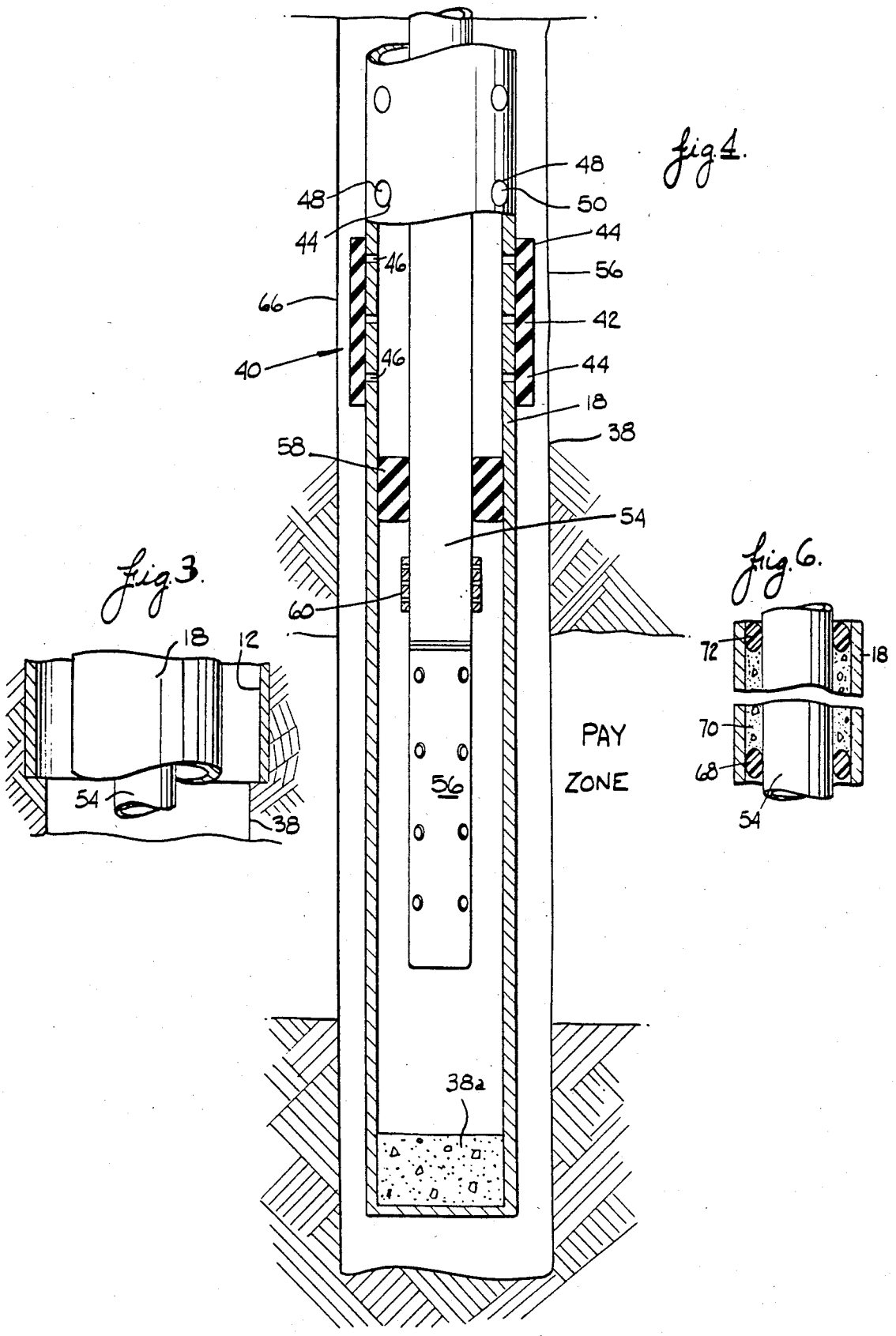
FIG. 3 is a view partially in section at a lower portion of the well.
FIG. 4 is a view partially in section of some of the components at the bottom of the well.
FIG. 6 is a view partially in section of the cement in place.

The next operation is to strip a 5 $\frac{1}{2}$ inch casing 18 into the well through the rotating head 34. The lower portion 38*a* of the 5 $\frac{1}{2}$ inch casing 18 is sealed, such as by filling the first two joints with cement. An external casing packer 40 is located at a predetermined position on the outer surface of the 5 $\frac{1}{2}$ inch casing 18. Although only one external casing packer 40 is illustrated, it is to be understood that a plurality of external casing packers may be used. The external casing packer 40 is located a predetermined distance above the pay zone. The external casing packer 40 illustrated in FIG. 4 comprises an expandable sleeve 42 the ends 44 of which are firmly sealed to the outer surface of the 5 $\frac{1}{2}$ inch casing 18. A plurality of holes 46 are made in the 5 $\frac{1}{2}$ inch casing 18 between the ends 44 of the sleeve 42 through which the fluid used to expand the sleeve 42 will pass. The 5 $\frac{1}{2}$ inch casing 18 is provided with a plurality of cementing ports 48 filled with a suitable material 50 capable of being blown out at suitable pressures, as described below.

As the 5 $\frac{1}{2}$ inch casing 18 is being stripped into the hole through rotating head 34, gas is flowing out of the exit 36 to a blooie line and out of the bleed line 22 to the blooie line. When the predetermined amount of 5 $\frac{1}{2}$ inch casing 18 has been stripped into the hole, the rubbers in the annular blow out preventer 30 are inflated so that the gas flow is only through the two 4" bleed off lines 22. The rotating head is lifted so that the slip insertion spool 32 is accessible. The slip insertion spool 32 is opened and the slips 16 are attached to the 5 $\frac{1}{2}$ inch casing 18. The slip insertion spool 32 is reassembled and the rotating head moved back into position and the rubbers of the annular blow preventer 30 are deflated so that some gas is again flowing out of exit 36. The 5 $\frac{1}{2}$ inch casing 18 is lowered until the slips are seated in the casing head 20 so that the gas from the drill hole 38 is flowing through the annular space between the outer surface of the 5 $\frac{1}{2}$ inch casing 18 and the inner surface of the 9 $\frac{5}{8}$ inch casing 12 and out through bleed line 22 to the bleed off lines. The use of the slip insertion spool is the preferred embodiment of the invention. However, under some conditions, the slips 16 of the 5 $\frac{1}{2}$ inch casing 18 can be attached and then moved through the rubbers in the rotating head.

Figure 5:
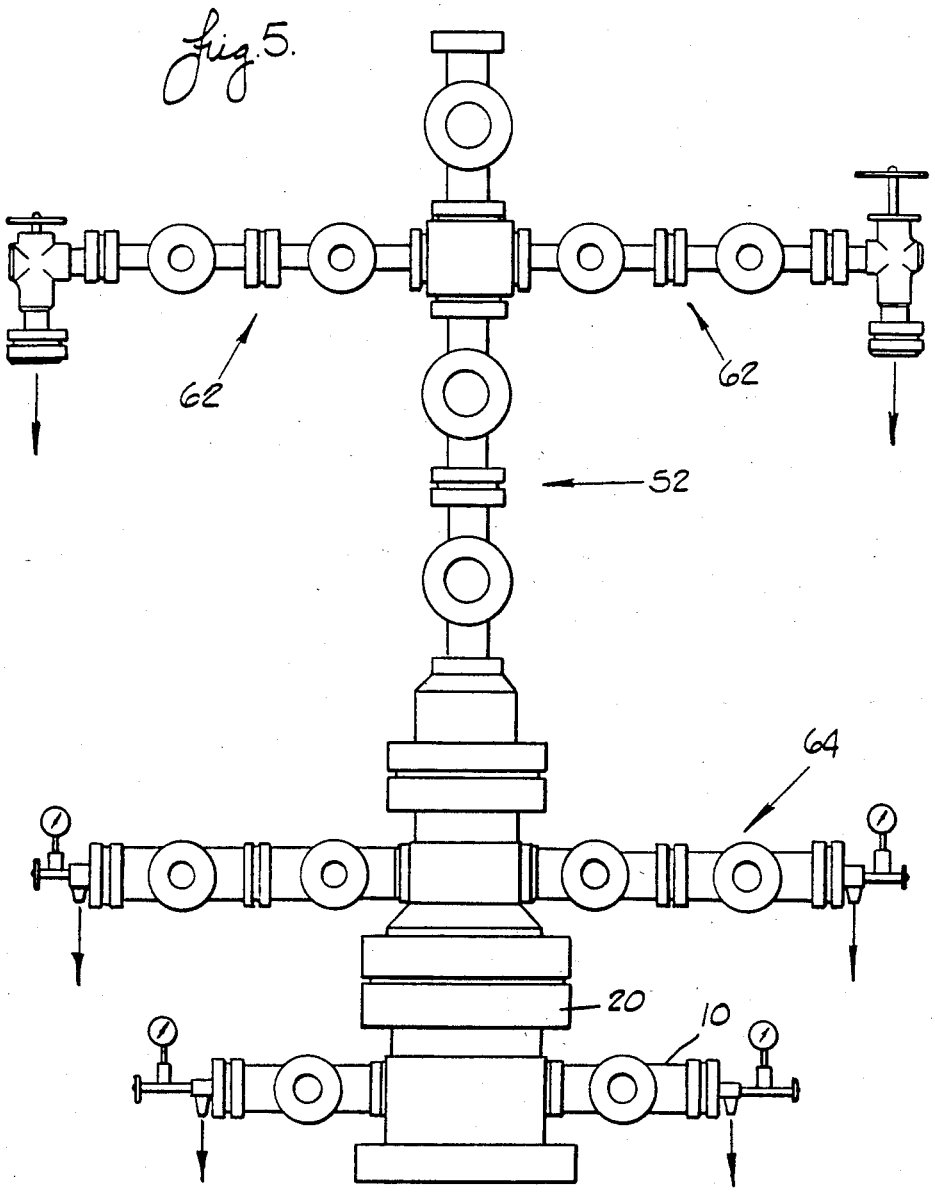
FIG. 5 is a view illustrating a completion rig in place.

The ram type blow preventers 26 and 28, the annular type blow preventer 30, the slip insertion spool 32 and the rotating head are removed and the completion rig is moved into position (or the drilling rig can be used for completion). The 2 $\frac{7}{8}$ inch tubing 54 is run in with apparatus, as described below, and including the christmas tree 52, illustrated in FIG. 5, is positioned on the casing head 20. The 5 $\frac{1}{2}$ inch casing 18 is cut prior to the positioning of the christmas tree 52. A perforating gun 56 is secured to the lower end 18 of the 2 $\frac{7}{8}$ inch tubing. An external packer 58 is secured to the outer surface of the 2 $\frac{7}{8}$ inch tubing 54 at a predetermined location so that the external packer 58 is located below the external packer 40 secured to the outer surface of the 5 $\frac{1}{2}$ inch casing 18. The external packer 58 can be of any conventional design. A perforated collar 60 is secured to the 2 $\frac{7}{8}$ inch tubing between the external packer 58 and the perforating gun 56 to provide a passageway for the gas from the pay zone into the 2 $\frac{7}{8}$ inch tubing after the perforating gun has been discharged. After all of the 2 $\frac{7}{8}$ inch tubing 54 has been installed, the external packer 58 is expanded so as to provide a seal between the outer surface of the 2 $\frac{7}{8}$ inch tubing 54 and the inner surface of the 5 $\frac{1}{2}$ inch casing 18. Although only one external packer 58 is illustrated, it is to be understood that a plurality of external packers 58 may be utilized. The apparatus is now in position so that the well may be completed as described below.

A suitable detonator (not shown) is dropped down the 2 $\frac{7}{8}$ inch tubing 54 to discharge the perforating gun 56 to make openings in the 5 $\frac{1}{2}$ inch casing 18. Gas from the pay zone moves through the openings formed by the blast from the perforating gun. Since the external packer 58 has formed a seal between the 2 $\frac{7}{8}$ inch tubing 54 and the 5 $\frac{1}{2}$ inch casing 18, as described above, the only exit for the gas entering into the 5 $\frac{1}{2}$ inch casing 18 is through the 2 $\frac{7}{8}$ inch tubing 54. Gas is also continuing to flow upwardly in the annulus between the 5 $\frac{1}{2}$ inch and 9 $\frac{5}{8}$ inch casings. Valves 62 control the flow of gas through the 2 $\frac{7}{8}$ inch tubing.

Water (KCl) is now fed through valve 64 into the annulus between the 2 $\frac{7}{8}$ inch tubing 54 and the 5 $\frac{1}{2}$ inch casing 18. The external packer 58 will limit the movement of the water so that hydrostatic pressure will start building. When the hydrostatic pressure has reached a predetermined amount, such as about 4000 psi, the external packer sleeve 42 will start to expand and will continue to expand until it is in sealing engagement with the wall 66 of the 8 $\frac{1}{2}$ inch hole 38. Additional water is added until the hydrostatic pressure reaches a predetermined amount, such as about 4500 psi, at which pressure, the material 50 is blown out of the cement ports 48. Water is continued to be added and flows out through the ports 48 and then upwardly in the annulus between the 5 $\frac{1}{2}$ inch casing 18 and the 9 $\frac{5}{8}$ inch casing 12. The addition of the water is continued until the well is full of water.

Cement is introduced into the annulus between the 5 $\frac{1}{2}$ inch casing 18 and the 9 $\frac{5}{8}$ inch casing 12. A predetermined amount of cement is introduced and is moved down the annulus until the bottom of the cement is at a desired point above the cement ports 48. The location of the bottom of the cement may be readily determined by knowing the amount of water displaced out of the annulus between the 2 $\frac{7}{8}$ inch tubing 54 and the 5 $\frac{1}{2}$ inch casing 18. During all these operations, gas continues to flow through the 2 $\frac{7}{8}$ inch tubing 54. The cement is allowed to set until it has reached a predetermined hardness. The foregoing procedures allow the cement to be introduced and set with no contact between the cement and the deleterious gases at the high pressures prevailing in the well. After the cement has set, the flow of gas through the 2 $\frac{7}{8}$ inch tubing 54 is stopped by shutting in the well.

In another embodiment, the 2 $\frac{7}{8}$ inch tubing 54 is provided with internal joints so that its complete external surface is smooth. A cement sealing plug 68 is positioned in the annulus between and in contact with the 2 $\frac{7}{8}$ inch tubing 54 and the 5 $\frac{1}{2}$ inch casing 18. Cement 70 is then introduced and forces the cement sealing plug to move downwardly. When the desired amount of cement has been introduced, another cement sealing plug 72 is installed and water or other means is used to force the cement sealing plugs 68 and 72 and the cement 70 to move downwardly until they are in the desired location.

Figure 7:
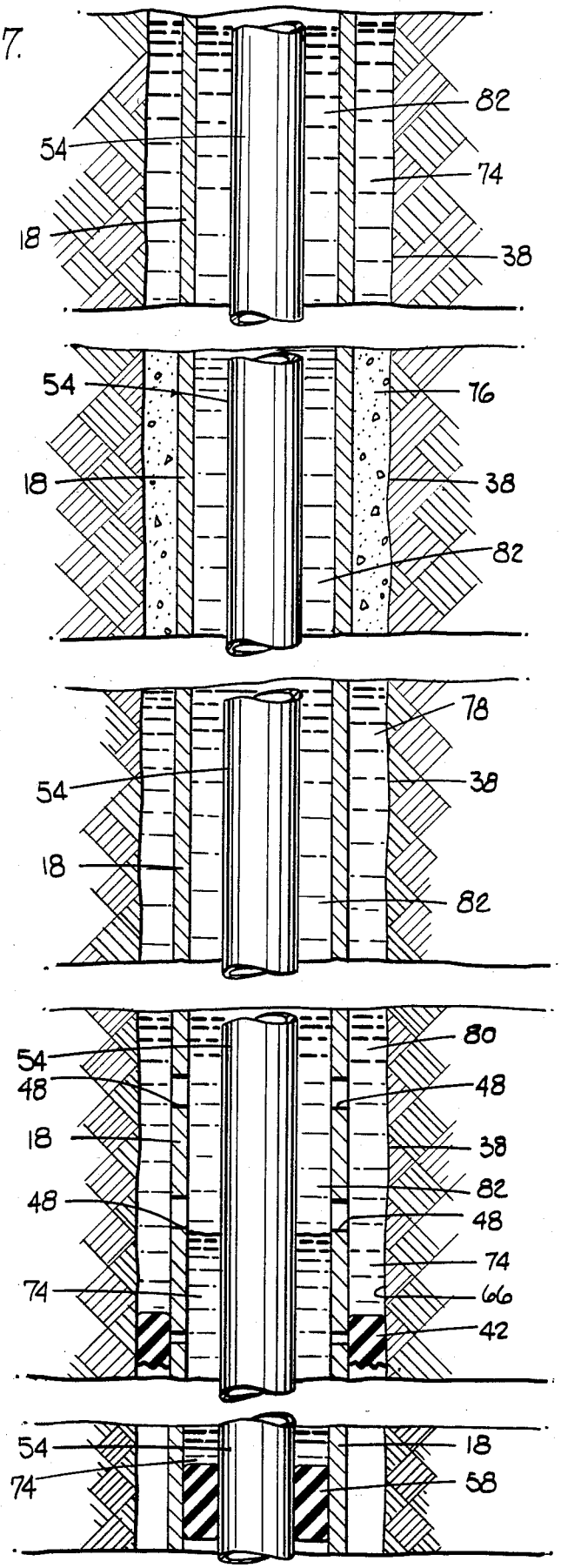
FIG. 7 is a view partially in section showing a completed well.

In another embodiment of the invention, illustrated in FIG. 7, a different procedure is followed after the detonator has been fired to make the openings in the 5 $\frac{1}{2}$ inch casing 18. A heavy dense fluid, such as a zinc bromide solution 74, is introduced into the annulus between the 2 $\frac{7}{8}$ inch tubing 54 and the 5 $\frac{1}{2}$ inch casing 18. The zinc bromide solution 74 moved downwardly in the annulus until it contacts the external packer 58 between the 2 $\frac{7}{8}$ inch tubing 54 and the 5 $\frac{1}{2}$ inch casing 18. The external packer 58 limits the movement of the zinc bromide solution 74 so that the hydrostatic pressure will start building. When the hydrostatic pressure on the zinc bromide solution has reached a predetermined amount, such as about 4000 psi, the external packer sleeve 42 will start to expand and will continue to expand until it is in sealing engagement with the wall 66 of the 8 $\frac{1}{2}$ inch hole 38. Additional zinc bromide or other material is added until the hydrostatic pressure reaches a predetermined amount, such as about 4500 psi, at which pressure, the material 50 is blown out of the cement ports 48. The zinc bromide solution 74 flows out through the ports 48, downwardly in the annulus between the 5 $\frac{1}{2}$ inch casing 18 and the 8 $\frac{1}{2}$ inch hole 38 into contact with the packer sleeve 42 and then upwardly in the annulus between the 5 $\frac{1}{2}$ inch casing 18 and the 8 $\frac{1}{2}$ inch hole 38. Sufficient amounts of zinc bromide solution are used to insure that the level of the zinc bromide solution 74 in the annulus between the 5 $\frac{1}{2}$ inch casing 18 and the 8 $\frac{1}{2}$ inch hole 38 is above the upper cement ports 48.

After the sufficient amount of zinc bromide solution 74 has been introduced, cement 76 is introduced into the annulus between the 2 $\frac{7}{8}$ inch tubing 54 and the 5 $\frac{1}{2}$ inch casing 18. The cement 76 is forced to move downwardly through the annulus and then outwardly through the cement ports 48. The portion of the zinc bromide between the lowest cement ports 48 and the external packer 58 remains in place. However, as the cement 76 moves through the cement ports 48, it pushes the zinc bromide solution 74 ahead of if upwardly in the annulus between the 5 $\frac{1}{2}$ inch casing 18 and the 8 $\frac{1}{2}$ inch hole 38. A predetermined amount of cement 76 is introduced into the annulus between the 2 $\frac{7}{8}$ inch tubing 54 and the 5 $\frac{1}{2}$ inch casing 18.

Acid water 78 is then introduced into the annulus between the 2 $\frac{7}{8}$ inch tubing 54 and the 5 $\frac{1}{2}$ inch casing 18 under pressure. The acid water 78 forces the cement 76 out through the cement ports 48 and upwardly in the annulus between the 5 $\frac{1}{2}$ inch casing 18 and the 8 $\frac{1}{2}$ inch hole 38 until the cement is in the desired location. In addition to applying a force to move the cement, the acid water 78 cleans the adjacent surfaces of the 2 $\frac{7}{8}$ inch tubing 54 and the 5 $\frac{1}{2}$ inch casing 18.

A second heavy dense fluid, such as a zinc bromide solution 80, follows the acid water 78 into the annulus between the 2 $\frac{7}{8}$ inch tubing 54 and the 5 $\frac{1}{2}$ inch casing 18. After a predetermined amount of the second zinc bromide solution has been introduced, acid water 82 under pressure is introduced into the annulus between the 2 $\frac{7}{8}$ inch tubing 54 and the 5 $\frac{1}{2}$ inch casing 18. The acid water 82 is continued to be introduced until the cement is in the desired position. The final condition of the well is illustrated in FIG. 7 and comprises in the annulus between the 2 $\frac{7}{8}$ inch tubing 54 and the 5 $\frac{1}{2}$ inch casing 18, a portion of the first zinc bromide solution 74 from the lowest cement port 48 to the external packer 58 and above that the acid water 82. In the annulus between the 5 $\frac{1}{2}$ inch casing 18 and the 8 $\frac{1}{2}$ inch hole 38, there is located a portion of the first zinc bromide solution 74 from the lowest cement port 48 to the external packer sleeve 42; above that the second zinc bromide solution 80; above that the first acid water 78; above that the cement 76; and above that the first zinc bromide solution 74.

It is to be understood that dimensions of the various components may be chosen for different types of wells.

While the preferred embodiments of the invention have been illustrated and described herein, it may be otherwise embodied and practiced within the scope of the following claims.

What is claimed is:

1. In a well having tubing extending downwardly into a well hole and with a casing surrounding the tubing so as to form a first annulus and a well hole surrounding at least a portion of said casing to form a second annulus; a seal between the tubing and casing; an external packer capable of being expanded located a predetermined distance above said seal and when in expanded condition forming a seal between said casing and said well hole; and a plurality of passageways through said casing filled by a material that may be forced out under pressure located a predetermined distance above said external packer, a method comprising:

flowing a first fluid through said annulus between said casing and said tubing;

blocking the flow of said first fluid by said seal between said casing and said tubing; and continuing the flow of said first fluid until the pressure in said first annulus is sufficient to expand said external packer to form a seal between said casing and the surrounding wall of said well hole.

2. A method as in claim 1 and further comprising:

continuing the flow of said first fluid until the pressure in said first annulus is sufficient to push said material out of said passageways so that said fluid may flow through said passageways and into said second annulus between said casing and said well hole.

3. A method as in claim 2 and further comprising:

pumping flowable cement into said first annulus;

moving said flowable cement downwardly in said first annulus; and continuing the pumping of said flowable cement until a predetermined amount has been pumped into said first annulus.

4. A method as in claim 3 and further comprising:

introducing a second fluid under pressure into said first annulus; and forcing said flowable cement downwardly in said first annulus.

5. A method as in claim 4 and further comprising:

introducing a third fluid under pressure into said first annulus.

6. A method as in claim 5 and further comprising:

introducing a fourth fluid under pressure into said first annulus;

forcing substantially all of said first fluid above said passageways out of said first annulus and into said second annulus and upwardly in said second annulus;

forcing substantially all of said cement out of said first annulus and into said second annulus and upwardly in said second annulus;

forcing substantially all of said second fluid out of said first annulus and into said second annulus and upwardly in said second annulus; and forcing substantially all of said third fluid out of said first annulus and into said second annulus.

7. A method as in claim 6 and further comprising:

using zinc bromide as said first fluid;

using acid water as said second fluid;

using zinc bromide as said third fluid; and using acid water as said fourth fluid.

8. A method as in claim 5 and further comprising:

using zinc bromide as said third fluid.

9. A method as in claim 4 and further comprising:

forcing said first fluid out of said first annulus and into said second annulus;

forcing said cement out of said first annulus and into said second annulus; and forcing said first fluid to move upwardly in said second annulus.

10. A method as in claim 4 and further comprising:

using zinc bromide as said first fluid; and using acid water as said second fluid.

11. A completed well formed by the method of claim 7.

* * * * *